United States Patent [19]

Bunk et al.

[11] Patent Number: 4,490,646

[45] Date of Patent: Dec. 25, 1984

[54] HALOGEN CYCLE INCANDESCENT LAMP HAVING AN INTERMEDIATE LEAD-IN CONDUCTOR PART

[75] Inventors: Axel Bunk, Ingolstadt; Karl Stadler, Pietenfeld, both of Fed. Rep. of Germany

[73] Assignee: Patent-Treuhand-Gesellschaft fur Elektrische Gluhlampen mbH, Munich, Fed. Rep. of Germany

[21] Appl. No.: 379,636

[22] Filed: May 19, 1982

[30] Foreign Application Priority Data

Jun. 26, 1981 [DE] Fed. Rep. of Germany ..... 3125192

[51] Int. Cl.[3] ..... H01K 1/20; H01K 1/40

[52] U.S. Cl. ..... 313/579; 313/631; 313/332

[58] Field of Search ..... 313/285, 332, 579, 631, 313/578, 580

[56] References Cited

U.S. PATENT DOCUMENTS 1,547,180 7/1925 Murphy ..... 313/332 X 2,716,714 8/1955 Adams et al. ..... 313/332 X

*Primary Examiner*—Palmer Demeo

*Assistant Examiner*—Sandra L. O'Shea

*Attorney, Agent, or Firm*—Frishauf, Holtz, Goodman & Woodward

[57] ABSTRACT

To prevent the occurrence of brittle weld junctions upon joining thin internal lead-in wires (3*a*, 3*a'*) to thicker connecting pin wires (3*b*, 3*b'*), an intermediate element of nickel (4) is positioned between the thinner and thicker wire parts, the nickel joining easily with the two parts of the molybdenum wires. The junction molybdenum-nickel-molybdenum, or tungsten-nickel-tungsten in case tungsten wires are used, is preferably located within the region of the press (5) of the lamp (1). In contrast to direct welding of molybdenum to molybdenum, or tungsten to tungsten, the weld does not decay.

10 Claims, 2 Drawing Figures

HALOGEN CYCLE INCANDESCENT LAMP HAVING AN INTERMEDIATE LEAD-IN CONDUCTOR PART

The present invention relates to a halogen cycle incandescent lamp, and more particularly to such a lamp which has a lamp housing made of quartz glass or hard glass and current leads passing through the housing which, simultaneously, may serve as connecting pins for the lamp.

BACKGROUND

It has been proposed to make halogen cycle incandescent lamps with connecting leads passing through the glass housing, made of molybdenum or tungsten wire. The high temperature of operation of halogen lamps requires the use of quartz glass or hard glass for the lamp housing. The internal connections of the lamp lead-in wires are usually much smaller or thinner than the external connections of the lamp leads if the external connections are to be used at the same time as connecting pins which can be fitted into a socket formed as a connector with spring clips to make electrical contact with the projecting lead-in wires. In order to connect the externally projecting pins and the internally projecting lead-in elements, welding processes have been used. It has been found that if molybdenum lead-in wires or tungsten lead-in wires are welded together, regions of brittle zones may form at the weld points. This detracts from the mechanical strength of the lead-in wires as well as of the lamp as a whole.

THE INVENTION

It is an object to provide a lamp in which lead-in wires can be used having lead wires which are thicker at the outside than at the inside, and in which weakening of the lead-in connections is eliminated.

Briefly, an intermediate connecting element of nickel is used between the internally projecting and externally projecting lead-in wires which may be made either of molybdenum or tungsten, for example. Either arc-welding or flame-welding is a suitable process for welding together the internally projecting lead-in wires to the externally projecting wires with the intermediate nickel connector.

DRAWINGS

Figure 1:
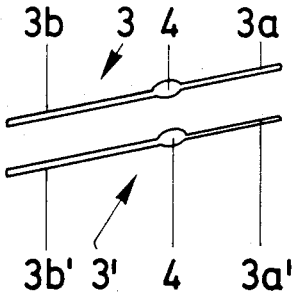
Figure 2:
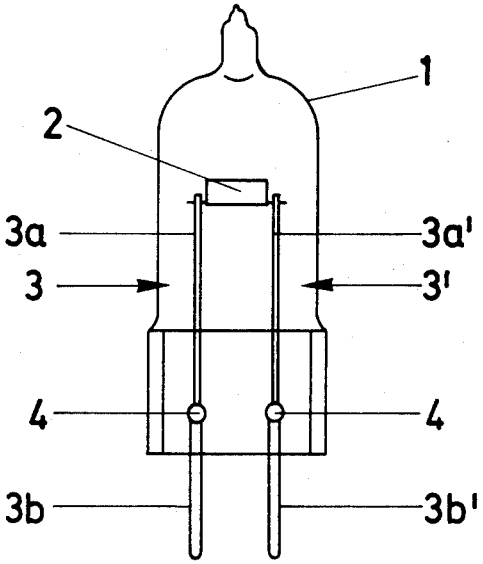

FIG. 1 is a schematic illustration of two lead-in connectors for a halogen cycle incandescent lamp; and FIG. 2 is a halogen cycle incandescent lamp with a housing made of hard glass and pin socket connections.

A housing 1 (FIG. 2) of hard glass retains therein a filament 2. The filament 2 receives electrical power and is mechanically supported by leads 3, 3'. The leads 3, 3' are made of two parts *3a*, *3b* and *3a'*, *3b'*, respectively. The two parts *3a*, *3b* and *3a'*, *3b'*, respectively, have different diameters. The wires 3, 3' are of molybdenum. The diameter of the wire portions *3a*, *3a'* may, for example, be about 0.4 mm. The diameter of the wire portions *3b*, *3b'*, which form connection pins, may for example be about 0.7 mm.

In accordance with the invention, the thinner, internally projecting wires *3a*, *3a'* are joined to the respective externally projecting wire pins *3b*, *3b'* by an interposed short element 4 of nickel. The element 4 of nickel may be a short piece of nickel wire, having a diameter which, preferably, at least approximately matches the diameter of the externally projecting pins *3b*, *3b'*, in this case a diameter of about 0.7 mm. It can be very short, for example only about 0.3 mm long. The weld connection, with the interposed nickel element 4, can be done by arc-welding. Flame-welding is also suitable.

The nickel element 4 forms a welding assistance zone. The nickel portion eliminates direct connection, by welding, of molybdenum-to-molybdenum, or of tungsten-to-tungsten, if tungsten wires are used; thus, the danger of obtaining a brittle zone within the joined or welded lead wires 3, 3' is eliminated. The welding or connecting zone normally is positioned within the region of the press 5 of the lamp. A weld connection molybdenum-nickel-molybdenum provides for reliable mechanical strength of the wires, and eliminates breakage of the lamp or lamp housing, particularly in the region of the press 5, as well as damage to the pins in case of careless installation of the lamp in a socket, or when subjected to vibration or shock. The molybdenum-nickel-molybdenum or tungsten-nickel-tungsten junction, particularly when located within the press of a lamp, provides a reliable, secure and air-tight connection. In contrast to a weld formed by direct welding of molybdenum to molybdenum, or tungsten to tungsten, the weld which includes the intermediate part of nickel does not decay.

We claim:

1. Halogen cycle incandescent lamp having a lamp bulb (1) of quartz glass or hard glass including a stem press (5) closing the lamp bulb;

multi-part lead-in wires (3, 3') having a first part (*3b*, *3b'*) leading from outside the bulb into the press, and a second part (*3a*, *3a'*) leading from the press into the inside of the bulb, said lead-in wires being of different diameter and comprising molybdenum or tungsten, and wherein, in accordance with the invention, an intermediate part (4) of nickel is provided, positioned between and joining together the respective parts of the lead-in wires, a portion of the first and second parts of the wires and the intermediate part of nickel (4) being located within the zone of the press (5) of the lamp.

2. Lamp according to claim 1, wherein said intermediate part of nickel is connected to said parts of the wires by arc-welding.

3. Lamp according to claim 1, wherein said intermediate part of nickel is connected to said parts of the wire by flame-welding.

4. Lamp according to claim 1, in which the smaller diameter part of the wires is positioned inside the lamp bulb, the larger diameter part of the wires forming connecting pins, and extending outside of the press (5).

5. Lamp according to claim 4, wherein the part of the wires inside of the lamp bulb has a diameter in the order of about 0.3 mm; and the part of the wires extending outside of the press has a diameter of about 0.7 mm.

6. Lamp according to claim 5, wherein the intermediate part of nickel has a diameter approximately the size of the diameter of the larger projecting parts of the wires and a length in the order of about the thickness of the smaller diameter or thinner part of the wires.

7. Lamp according to claim 5, wherein said wires comprise molybdenum wires.

8. Lamp according to claim 5, wherein said wires comprise tungsten wires.

9. Lamp according to claim 1, wherein said wires comprise molybdenum wires.

10. Lamp according to claim 1, wherein said wires comprise tungsten wires.

* * * * *